United States Patent [19]

Heimbach et al.

[11] 4,410,134

[45] Oct. 18, 1983

[54] METHOD OF AND APPARATUS FOR OPERATING A MONOVALENT ALTERNATIVE ABSORPTION HEATING INSTALLATION

[75] Inventors: Paul Heimbach, Cologne; Peter Goebel; Franz Gruber, both of Brühl, all of Fed. Rep. of Germany

[73] Assignee: Buderus Aktiengesellschaft, Wetzlar, Fed. Rep. of Germany

[21] Appl. No.: 292,427

[22] Filed: Aug. 14, 1981

[30] Foreign Application Priority Data

Aug. 16, 1980 [DE] Fed. Rep. of Germany ..... 3031033

[51] Int. Cl.[3] ..... F25B 27/00; F25B 15/00

[52] U.S. Cl. ..... 237/2 B; 62/476; 62/486; 62/483; 62/238.3

[58] Field of Search ..... 237/2 B; 62/483, 489, 62/238.3, 486, 476; 165/62

[56] References Cited

U.S. PATENT DOCUMENTS 4,312,476 1/1982 Pohlmann ..... 237/2 B 4,314,668 2/1982 Jansen et al. ..... 237/2 B

*Primary Examiner*—Albert J. Makay

*Assistant Examiner*—Henry Bennett

*Attorney, Agent, or Firm*—Karl F. Ross; Herbert Dubno

[57] ABSTRACT

A method of operating a monovalent alternative absorption heating plant an apparatus operated by this method in which above a predetermined ambient temperature, the system is operated in a heat pump mode and at lower temperatures, in a direct heating mode. The system uses a coolant (refrigerant) circulation path in which the coolant is driven out of a solvent enriched with the coolant, is liquefied, is vaporized by heat exchange with the environment and is absorbed by coolant-poor solvent. The system also has a heat carrier circulation in which the heat carrier is heated by heat exchange with the continuing coolant and thus takes up absorption heat. According to the invention, in the direct heating mode, the heat carrier bypasses the coolant condenser and absorber and is passed through a heat exchanger separate from the coolant condenser and is there heated directly by combustion heat in a heat generator or by heat exchange with the coolant-poor solvent.

8 Claims, 2 Drawing Figures

METHOD OF AND APPARATUS FOR OPERATING A MONOVALENT ALTERNATIVE ABSORPTION HEATING INSTALLATION

FIELD OF THE INVENTION

Our present invention relates to a method of operating an absorption heating installation and to the installation which comprises a monovalent alternative absorption heating apparatus.

BACKGROUND OF THE INVENTION

It is known, in connection with space or utility water heating, to utilize an absorption heating plant which operates with a coolant (refrigerant) and a solvent in which the coolant is soluble with the heat of absorption being recovered. The coolant or refrigerant generally is ammonia while the solvent is generally water and, in addition to these fluids which can have respective circulating paths, a heat-carrying fluid, e.g. steam or hot water, can be provided.

Reference will be made herein to a coolant-rich or coolant-poor solvent to indicate that the solvent is either close to saturation in the coolant or has been practically stripped from the coolant, respectively.

It is known to provide a momovalent alternative absorption heating installation of this type which operates in a heat pump mode above a predetermined ambient temperature and which operates in a direct heating mode at lower temperatures.

In such systems, a condenser is provided for the refrigerant and an absorber is utilized to contact the solvent directly with the coolant, thereby bringing about absorption of the coolant by the solvent. The absorber, therefore, thus serves to convert the coolant-poor solvent into a coolant-rich solvent.

As noted, the system operates with a coolant circulation in which the coolant stripped or driven from the coolant-rich solvent is liquefied or condensed, vaporized by heat exchange with the environment and absorbed by the coolant-poor solvent.

In the heat-carrier circulation, a heat carrier is heated by heat exchange with the condensing coolant and by taking up absorption heat.

Such systems have been found to be practical for single family homes as well as for multifamily dwellings.

The appellation "monovalent alternative" as applied to such a heating unit indicates that the latter operates with only one primary energy source until a predetermined minimum ambient air temperature is achieved in a heat pump mode and below this temperature also can operate in a direct heating mode by the same energy source with direct heating of the heat carrier by this energy source.

An operation of this type is described in German patent document No. 27 58 773 which describes two variants for switching over the apparatus from heat pump mode to direct heating mode. In one case the solvent heated in a heat generator (a flame-type heater) is directly fed to the absorber for transfer of thermal energy to the heat carrier whereas, in the other case, the heated solvent passes successively through the coolant condenser and the absorber in heat exchange with the heat carrier.

Thus, in both cases, the solvent must traverse a number of elements, namely, the absorber, the condenser and the solvent pump, thereby raising the temperatures thereof well above the preferred temperatures during heat pump operation and resulting in considerable heat loss. In addition, heat exchange between the coolant-poor and coolant-free solvent from a high pressure in the stripper to the lower pressure of the absorber will result in a significant cooling of the solvent and thereby reduce the temperature differential between the solvent and the heat carrier in the absorber to diminish the rate of heat transfer therebetween.

It has also been found to be a disadvantage that the coolant-poor solvent traverses the condenser in the direct heating mode. When the system is switched over again to the heat pump mode, the solvent in the evaporator manifests an excessive cold loss. Finally, upon switching over from heat pump mode to direct heating mode, significant heat losses are observed as a result of the fact that the coolant vapor stripped from the solent releases its condensation heat to the environment upon condensation in the evaporator.

OBJECTS OF THE INVENTION

It is the principal object of the present invention to provide a method of operating an absorption heating installation of the aforedescribed type whereby the disadvantages thereof enumerated above are obviated or reduced.

Another object of this invention is to provide a method of operating a heating apparatus to minimize the heat losses and improve the heating efficiency thereof.

Another object of this invention is an improved absorption heating apparatus characterized by minimum heat loss and high efficiency.

SUMMARY OF THE INVENTION

These objects and others which will become apparent hereinafter are attained, in accordance with the present invention, in a monovalent alternative absorption heat installation and method wherein, during the direct heating mode, the heat carrier is conducted along a path which bypasses the coolant condenser and absorber and through a heat exchanger separate from the coolant condenser and is there heated by the direct supply of combustion heat from the heat generator and/or by heat exchange with coolant-poor solvent.

Thus the heating of the heat carrier in the direct heating mode is effected preferably by a heat exchanger exclusively provided for this purpose, the separate heat exchanger being either traversed by the coolant-poor solvent or is disposed in the heat generator to be heated by the flame or hot gases from the combustion heat directly.

As a result, the heat transfer to the heat carrier can be effected under optimum conditions and heating of the absorber and the coolant condenser is avoided. Heat losses in the apparatus are materially reduced.

According to an important feature of the invention, after heat exchange with the heat carrier, the coolant-poor solvent is passed through a temperature changer (heat exchanger) for indirect heat exchange with coolant-rich solvent.

It has been found to be advantageous to pass the heat carrier into indirect heat exchange with vapor flowing downwardly in a reflux condenser in a rectifier and/or with the exhaust gases (flux gases) from the heat generator or combustion chamber.

As a result of such heat exchange with the flue gases, residual heat in the flue gases can be recovered conveniently. This heat exchange, however, is not intended to replace the direct transfer of combustion heat to the heat carrier in accordance with the present invention.

It has been found to be advantageous, further, in the direct heating mode to provide means for cutting off the heating from the environment of the coolant evaporator and absorber. Such means can include means for cutting off the blower which supplies ambient air and/or valves for interrupting the coolant flow from evaporator to absorber.

According to yet a further feature of the invention, the valves or the like for switchover from heat pump mode to direct heating mode and vice versa are controlled by a central unit.

An apparatus for carrying out the method of this invention thus comprises the coolant circulation including a stripper, a condenser, an evaporator and an absorber, a heating circulation including the condenser and the absorber, and in accordance with a feature of this invention, a separate heat exchanger in the heat carrier circulation which forms a further flow cross section for the coolant-poor solvent or is disposed in the heat generator.

In the first case, a separate heat exchanger is provided externally of the heat generator, whereas in the second case, such means is provided in the region of combustion within the heat generator.

In the second embodiment, the heat generator for heat pump operation and direct heating operation is alternatively associated with the stripper and with the separate heat exchanger. Between the heat generator and the stripper or the added heat exchanger, swingable flap valves can be provided which, depending on their positions, transfer heat exclusively to the stripper or to the added heat exchanger.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
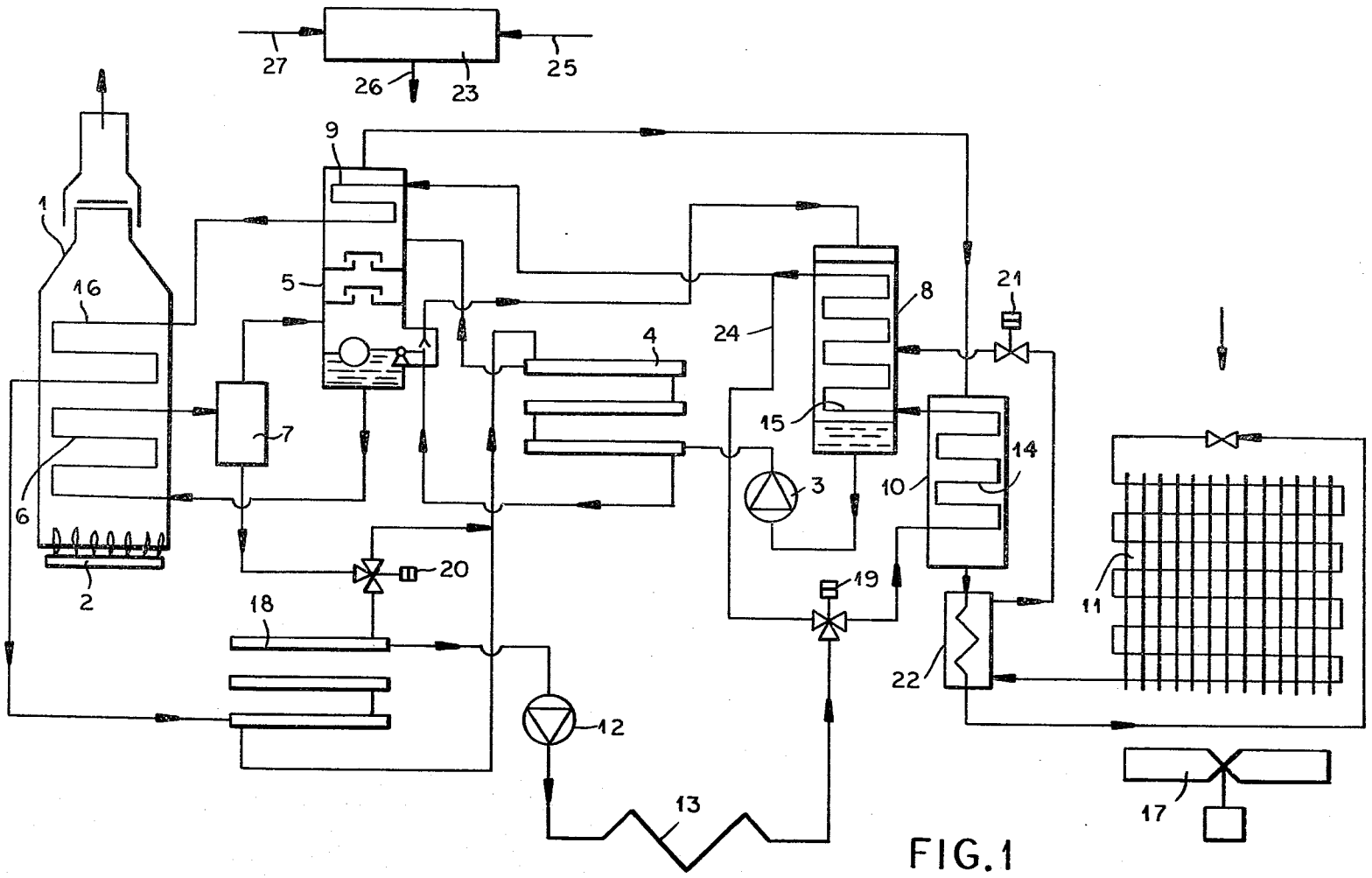
FIG. 1 is a schematic flow diagram illustrating an absorption heating apparatus embodying the present invention.

The absorption heating apparatus shown in FIG. 1 comprises a heat generator 1 (which can have the configuration shown in FIG. 2), provided with a heat-producing element 2 such as an atmospheric gas burner. The apparatus also comprises a solvent circulation path which, in the direction of flow of the solvent, includes in succession a solvent pump 3, a temperature changer or heat exchanger 4, a rectifier or rectification column 5 which can be of the multiplate type formed with a reflux condenser at its upper end and a liquid collecting sump at its bottom, a stripper 6 disposed in the heat generator 1, a liquid/vapor separator 7 and an absorber 8.

The apparatus also comprises a coolant circulation path which begins in the vapor space of the separator 7 and, in succession, extends through the coil 9 at the head of the rectifier 5, a condenser 10, a cooling heat exchanger 22 and an evaporator 11 formed as an air cooler. From the latter the path extends to the absorber 8 in which the refrigerant is picked up by the solvent and carried along the solvent path to the stripper 6.

The coolant/solvent mixture, generally a mixture of ammonia and water, is drawn from the sump of the absorber 8 passed in indirect heat exchange with coolant-poor solvent in the temperature changer 4 and fed to the rectifier 5.

In the rectifier 5, in material exchange with a coolant-rich gas fraction, the concentration of coolant in the gas mixture is increased while a coolant-rich solvent collects in the sump of the rectifier 5.

The coolant-rich solvent is then fed to the stripper 6 where it is heated with combustion heat and brought to a high pressure, the lquid then being expanded in the separator 7 at which a coolant-rich gas fraction is driven from the liquid. The coolant-rich gas fraction is returned to the rectifier 5 while the coolant-poor solvent, as the liquid phase, is drawn from the separator 7 and delivered to a distributing valve 20 which can be solenoid operated so that it can be reversed by a common control station as will be described subsequently.

During heat pump operation the liquid traverses the valve 20 and flows to the temperature changer 4. In the latter, the coolant-poor solvent is passed in indirect heat exchange with coolant-rich solvent and then is fed to the head of the absorber 8 at a rate, controlled by a fluid valve, which depends upon the liquid level in the sump of the rectifier 5.

In addition, the apparatus comprises a heat-carrier circulation path in which the heat-carrying fluid is circulated by a pump 12. This fluid flows from the pump 12, during heat pump operation, through the distributing solenoid valve 19 through the heating coils 14 and 15 in the condenser 10 and the absorber 8 to release heat therein. This fluid is then heated again in the condenser 9 at the head of rectifier 5 and in a flue gas cooler 16 in the heat generator 1.

According to the invention, an additional heat exchanger 18 is provided which is traversed by the heating medium which can also be utilized to deliver heat to a load represented at 13, e.g. for heating water or additional space heating purposes.

According to the invention, upon switchover from heat pump operation to direct heating operation, the magnetic valve 20 is shifted so that coolant-poor hot solvent is fed through the heat exchanger 18 and heats the heat-carrying medium therein. The separate heat exchanger 18 is dimensioned to optimize the heat transfer in this apparatus. After traversing the separate heat exchanger 18, the coolant-poor solvent enters the temperature changer 4.

Simultaneously with the operation of valve 20, the magnetic valve 19 is shifted so that the heating medium flows through a bypass 24 and thus bypasses the condenser 10 and the absorber 8. Excessive heating of these elements is therein avoided.

Furthermore, in switchover to the direct heating operation, the vapor return line from the air cooler 11 to the absorber is blocked and the blower 17 is cut off. All of these operations can be preprogrammed in a central control unit 23 represented diagrammatically which can be supplied with data representing ambient temperatures as shown at 25 and with an electric current as represented at 27, the control signals for the valves being delivered at 26.

Figure 2:
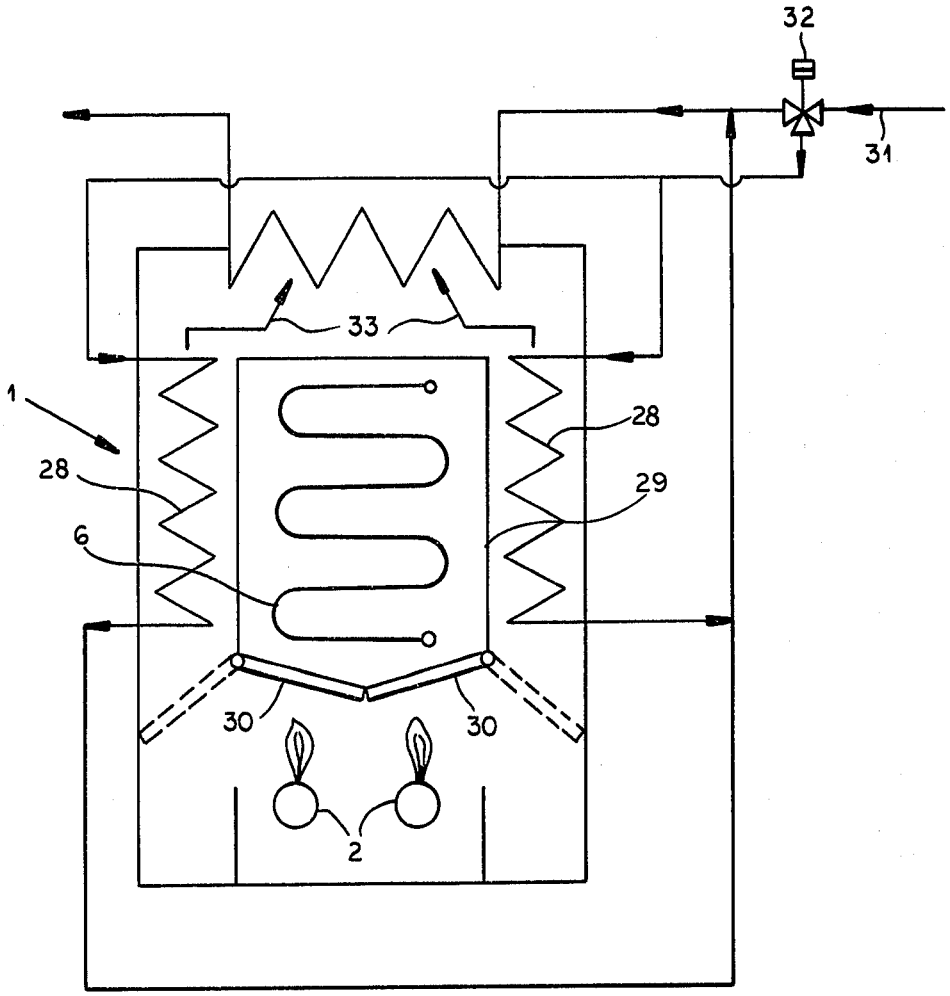
FIG. 2 is a diagrammatic cross section representing a heat generator in accordance with the invention.

The heat generator 1, preferably comprises the atmospheric gas burner 2 previously mentioned and can include above this burner 2, the stripper 6 and a heat exchanger 28 (FIG. 2).

In this embodiment, the heat exchanger 28, which is equivalent to the heat exchanger 18 in the circuit of FIG. 1 and is traversed by the heating medium, can comprise a pair of heating loops which are disposed outwardly of a partition 29 surrounding the stripper 6. Thus the spaces containing the heat exchanger 28 and the stripper 6 are separated from one another.

At the bottom of this partition, flaps 30 are provided which can be controlled by the circuit 23 and which, in direct heating operation, can cut off the stripper 6 and allow direct gas heating of the coils 28. In heat pump mode, these flaps assume the broken line positions in FIG. 2.

The flue gas flows upwardly (arrows 33) to heat the coil 16 in the manner described.

The fluid from the reflux condenser 9, represented by the arrow 31, flows through a magnetic distributing valve 32 also operated by the central controller 23 and either directly into the flue gas cooler 16 in heat pump operation or initially through the heat exchanger 28 and thereafter through the flue gas cooler for direct heating operation. In this case, a separate heat exchanger at 18 and the magnetic valve 20 of FIG. 1 are unnecessary.

We claim:

1. A method of operating an absorptive heating installation which comprises:

a heat generator, a solvent circulation path for a solvent adapted to absorb a coolant, said solvent circulation path including a solvent pump, a temperature changer for passing coolant-poor solvent in indirect heat exchange with coolant-rich solvent, a rectifier having a sump in which coolant-rich solvent collects, a stripper in said heat generator in which coolant-rich solvent is heated, and a separator in which coolant-rich solvent is separated into coolant vapor and a liquid phase consisting of said coolant-poor solvent, the vapor being fed to said rectifier, a coolant circulation path extending from said rectifier and including a condenser, a cold exchanger in which condensed coolant is passed in indirect heat exchange with coolant vapor, an evaporator receiving said coolant from said cold exchanger and producing coolant vapor, and an absorber for contacting solvent vapor with said coolant-poor solvent from said temperature changer to produce a coolant/solvent mixture which is supplied to said pump, and a circulation path for a heating medium extending through said condenser, said absorber and said rectifier, said method comprising:

in a heat pump mode above a predetermined ambient temperature feeding said solvent from said separator directly to said temperature changer and simultaneously conducting said heating medium through said condenser and said absorber;

in a direct heating mode below said temperature, circulating said heating medium so as to cause it to bypass said condenser and said absorber while heating said medium said heating medium being heated in said direct heating mode by passing it in indirect heat exchange in a further heat exchanger with coolant-poor solvent from said separator prior to feeding said coolant-poor solvent to said temperature changer; and preventing the supply of ambient heat to said evaporator and said absorber during said direct heating mode.

2. The method defined in claim 1 wherein said heating medium is heated in said direct heating mode by passing it through said heat generator for direct heating by combustion of fuel therein.

3. The method defined in claim 1, further comprising the step of additionally heating said medium by heat exchange with flue gas in said heat generator.

4. The method defined in 1, further comprising the step of switching between said modes utilizing a central switching unit.

5. In an absorptive heating installation which comprises a heat generator, a solvent circulation path for a solvent adapted to absorb a coolant, said solvent circulation path including a solvent pump, a temperature changer for passing coolant-poor solvent in indirect heat exchange with coolant-rich solvent, a rectifier having a sump in which coolant-rich solvent collects, a stripper in said heat generator in which coolant-rich solvent is heated, and a separator in which coolant-rich solvent is separated into coolant vapor and a liquid phase consisting of said coolant-poor solvent, the vapor being fed to said rectifier, a coolant circulation path extending from said rectifier and including a condenser, a cold exchanger in which condensed coolant is passed in indirect heat exchange with coolant vapor, an evaporator receiving said coolant from said cold exchanger and producing coolant vapor, and an absorber for contacting solvent vapor with said coolant-poor solvent from said temperature changer to produce a coolant/solvent mixture which is supplied to said pump, and a circulation path for a heating medium extending through said condenser, said absorber and said rectifier, the improvement which comprises a further heat exchanger for said medium, and means in a direct heating mode for circulating said heating medium through said further heat exchanger but bypassing said condenser and said absorber said further heat exchanger being connected to be traversed by said coolant-poor solvent between said separator and said temperature changer, and a valve-controlled bypass line bridged across coils for said heating medium in said condenser and said absorber.

6. The improvement defined in claim 5 wherein said further heat exchanger is disposed in said heat generator and is directly heated by combustion therein.

7. The improvement defined in claim 6, further comprising a partition between said stripper and said further heat exchanger in said heat generator and flap means for selectively heating said stripper and said further heat exchanger.

8. The improvement defined in claim 7 or claim 6, further comprising a flue gas cooler in said heat generator connected in said circulation path for said heating medium.

* * * * *